US007004493B2

(12) United States Patent
Junius et al.

(10) Patent No.: US 7,004,493 B2
(45) Date of Patent: Feb. 28, 2006

(54) SKI EDGE PROFILE

(75) Inventors: Hans-Toni Junius, Iserlohn (DE); Norbert Brachthäuser, Bochum (DE)

(73) Assignee: C.D. Walzholz-Brockhaus GmbH, Hagen (DE)

( * ) Notice: Subject to any disclaimer, the term of this patent is extended or adjusted under 35 U.S.C. 154(b) by 138 days.

(21) Appl. No.: 10/451,502

(22) PCT Filed: Jun. 12, 2002

(86) PCT No.: PCT/EP02/06414

§ 371 (c)(1),
(2), (4) Date: Jun. 20, 2003

(87) PCT Pub. No.: WO03/004112

PCT Pub. Date: Jan. 16, 2003

(65) Prior Publication Data

US 2004/0051276 A1 Mar. 18, 2004

(30) Foreign Application Priority Data

Jul. 6, 2001 (DE) ..... 101 32 293
Oct. 24, 2001 (DE) ..... 101 52 559

(51) Int. Cl.
*A63C 5/048* (2006.01)

(52) U.S. Cl. ..... 280/608; 280/11.18; 420/117

(58) Field of Classification Search ..... 280/608, 280/28, 11.18; 420/67, 103, 117, 127
See application file for complete search history.

(56) References Cited

U.S. PATENT DOCUMENTS 6,235,237 B1 * 5/2001 Osing et al. ..... 420/67
2003/0006583 A1 * 1/2003 Rozsnoki

FOREIGN PATENT DOCUMENTS

DE 297 05 070 U1 7/1997
DE 198 08 276 A1 9/1999
EP 311196 A1 * 4/1989

OTHER PUBLICATIONS

Search Report dated May 8, 2002 of German Application No. 101 52 559.1 filed Oct. 24, 2001.

* cited by examiner

*Primary Examiner*—Christopher P. Ellis
*Assistant Examiner*—Christopher Bottorff
(74) *Attorney, Agent, or Firm*—Maine & Asmus

(57) ABSTRACT

The invention relates to a ski edge profile made from steel. To further improve the sliding properties compared to the ski edge profiles which are known from the prior art, according to the invention it is proposed for the ski edge profile to consist of a steel alloy with a relatively low thermal conductivity.

19 Claims, 3 Drawing Sheets

| | Alloy 1 (Base) | Alloy 2 (Invention) |
|---|---|---|
| Chemical Analysis (%) | | |
| C | 0.55 - 0.80 | 0.50 - 0.80 |
| Si | 0.03 - 0.40 | 1.20 - 2.30 |
| Mn | 0.50 - 0.90 | 0.50 - 1.10 |
| P | max. 0.035 | max. 0.035 |
| S | max. 0.035 | max. 0.035 |
| Cr | 0.01 - 0.40 | 0.05 - 0.80 |
| Cu | max. 0.30 | max. 0.30 |
| Ni | max. 0.30 | max. 0.30 |
| Mo | max. 0.10 | max. 0.10 |
| Al | max. 0.070 | 0.001 - 0.25 |
| Sn | | max. 0.05 |
| As | | max. 0.05 |
| V | | 0.001 - 0.40 |
| Nb | | max. 0.05 |
| Sb | | max. 0.05 |
| B | | max. 0.01 |

| | Alloy 1 (Base) | Alloy 2 (Invention) |
|---|---|---|
| Chemical Analysis (%) | | |
| C | 0.55 - 0.80 | 0.50 - 0.80 |
| Si | 0.03 - 0.40 | 1.20 - 2.30 |
| Mn | 0.50 - 0.90 | 0.50 - 1.10 |
| P | max. 0.035 | max. 0.035 |
| S | max. 0.035 | max. 0.035 |
| Cr | 0.01 - 0.40 | 0.05 - 0.80 |
| Cu | max. 0.30 | max. 0.30 |
| Ni | max. 0.30 | max. 0.30 |
| Mo | max. 0.10 | max. 0.10 |
| Al | max. 0.070 | 0.001 - 0.25 |
| Sn | | max. 0.05 |
| As | | max. 0.05 |
| V | | 0.001 - 0.40 |
| Nb | | max. 0.05 |
| Sb | | max. 0.05 |
| B | | max. 0.01 |

Fig. 1a

| Typical values | Alloy 1 | Alloy 2 |
|---|---|---|
| C | 0.690 | 0.620 |
| Si | 0.240 | 1.930 |
| Mn | 0.620 | 0.910 |
| P | 0.007 | 0.014 |
| S | 0.014 | 0.007 |
| Cr | 0.037 | 0.350 |
| Cu | 0.041 | 0.170 |
| Ni | 0.025 | 0.130 |
| Mo | 0.010 | 0.040 |
| Al | 0.003 | 0.006 |
| **Typical values** | **Alloy 1** | **Alloy 2** |
| Density $\delta$ ($g/cm^3$) | 7.819 | 7.703 |
| | | |
| Thermal conductivity $\kappa$ (W/mK) | | |
| At °C | | |
| -20 | 45.5 | 22.8 |
| -10 | 46.1 | 23.3 |
| 0 | 46.6 | 23.7 |
| 10 | 47.0 | 24.2 |
| 20 | 47.4 | 24.7 |

Fig. 1b

SKI EDGE PROFILE

RELATED APPLICATIONS

This application is a National Stage of International Application No. PCT/EP02/06414, filed Jun. 12, 2002, which published in the German language and is an international filing of German Application Nos. 10132293.3, filed on Jul. 6, 2001, and 10152559.1, filed Oct. 24, 2001. Priority is claimed. Each of these references are herein incorporated by reference in their entirety.

FIELD OF THE INVENTION

The present invention relates to a ski edge profile made from steel and to a ski having a ski edge profile.

BACKGROUND OF THE INVENTION

A ski has a base body which generally consists of plastic and generally has a structure comprising a plurality of layers, which may be reinforced with glass fibers or carbon fibers, in order to achieve defined elasticity and shock absorption properties. The side edges of the running surface of the ski, which are subject to particularly high loads, are formed by ski edge profiles made from steel. This is a substantially L-shaped profile, one limb of which is unreleasably embedded in the base body. The profile head, which is generally ground at right angles, extends along the running surface edge, which is subject to particularly high loads.

It is known to use ski edge profiles made from steel, preferably hardened steel. A ski edge of this type is described, for example, in DE 297 05 070 U1. These known ski edges, which consist of hardenable steel alloys, have excellent properties in particular in terms of their durability and resistance to wear.

In view of the above, the invention is based on the object of providing a ski edge profile which further improves the sliding properties of a ski provided with ski edge profiles of this type, in particular under extreme loads as occur in ski racing.

BRIEF SUMMARY OF THE INVENTION

To achieve this object, it is proposed, according to the invention, for the ski edge profile to consist of a steel alloy with a relatively low thermal conductivity.

The invention is based on the surprising discovery that although it is almost impossible to significantly improve the sliding properties any further by improving the mechanical materials properties of the ski edge, there is still a potential for optimization in terms of the thermal properties, which has hitherto not been exploited.

BRIEF DESCRIPTION OF THE FIGURES

FIGS. 1*a* and 1*b* are tables illustrating typical values for the chemical analysis, density, and thermal conductivity for an alloy configured in accordance with one embodiment of the present invention.

DETAILED DESCRIPTION OF THE INVENTION

Figure 2:
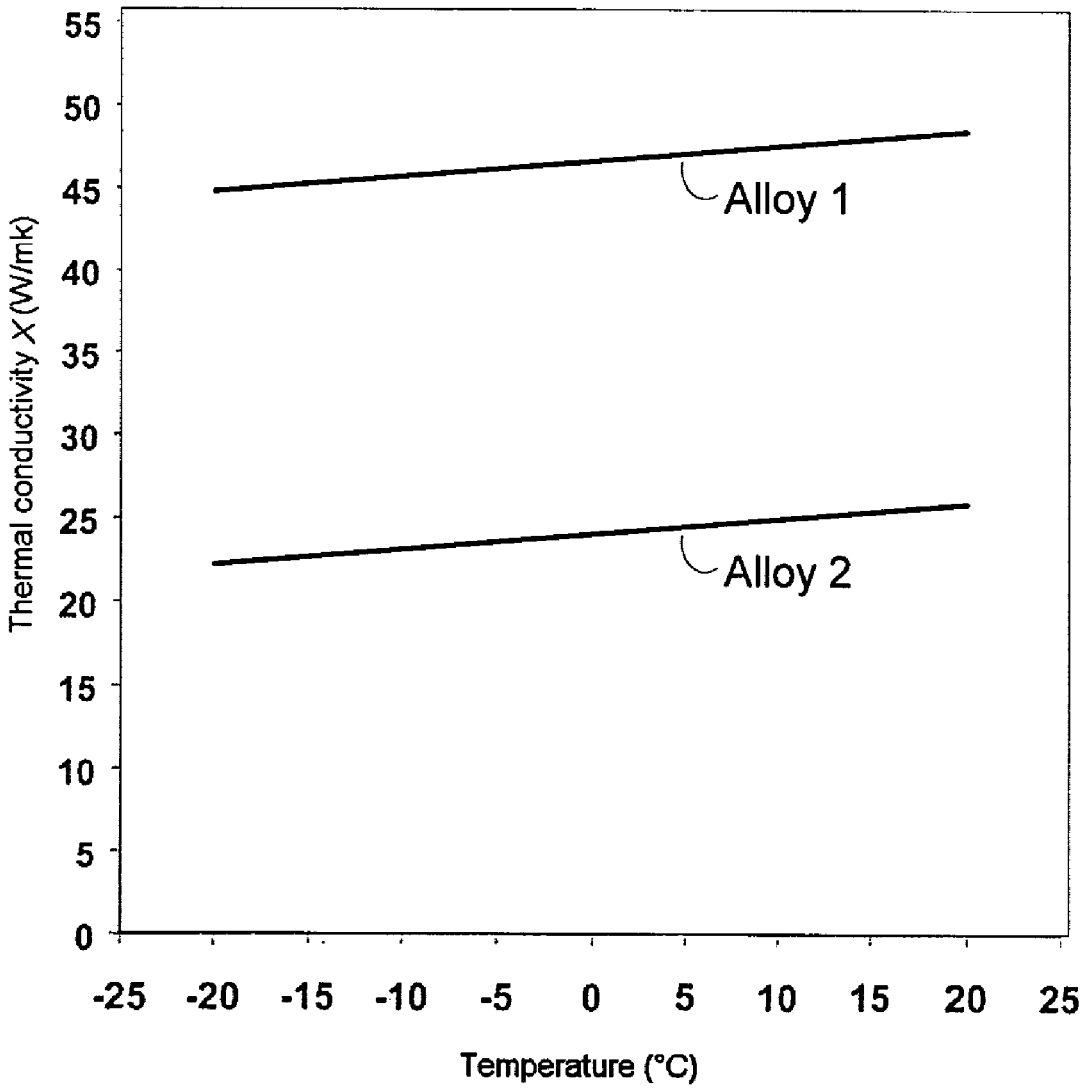
FIG. 2 is a graph illustrating a comparison between thermal conductivities associated with a conventional alloy and an alloy configured in accordance with an embodiment of the present invention.

The approach of the invention in detail provides for the use in particular of steel alloys which, on account of their alloying additions, have a lower thermal conductivity than the hardenable C steels which have been used hitherto.

The reduction in the thermal conductivity of the ski edge profile leads to a reduced dissipation of the heat produced in the edge region during skiing. This reduced dissipation of heat ensures that an improved sliding film is formed between the ski edge and the snow (as a result of local, brief melting of the snow), which improves the sliding properties so that the ski is faster.

The hardness, the wear resistance, the dimensional accuracy and the edge-holding properties of the ski edge made from steel are not adversely affected.

To achieve a reduced thermal conductivity in accordance with the invention, a steel alloy having an increased level of alloying elements which reduce the thermal conductivity is used. Such elements may, for example, be added silicon. The silicon content may be approximately between 0.3% and 3.0%, based on the melt analysis, preferably between 0.5% and 2.5%.

Other known constituents which induce the formation of a solid solution may also be used.

Silicon-alloyed carbon steels with a carbon content in the range from 0.5% –0.8% and a silicon content in the range 1.2%–2.3% (in % by weight) are particularly suitable for implementing the invention.

The tables illustrated in FIGS. 1*a* and 1*b* give the chemical analysis and typical values for the chemical analysis, density and thermal conductivity λ, specifically for an alloy 1 which is used in the prior art to produce ski edges and for an alloy 2 according to the invention:

The thermal conductivity of the alloy 2, which is reduced by virtually half compared to the known alloy 1 in the temperature range of interest from −20° C. to +20° C. can be seen particularly clearly from the graph illustrated in FIG. 2.

What is claimed is:

1. A ski edge profile made from steel, comprising a steel alloy with a thermal conductivity less than approximately 35 W/mK in the temperature range from −20 to +20° C.

2. The ski edge profile of claim 1, wherein the thermal conductivity of the steel alloy is reduced by at least one of nonmetallic, semimetallic, and metallic alloying elements.

3. The ski edge profile of claim 2, wherein the alloying elements which reduce the thermal conductivity form approximately 1.0% to 3.0%, based on the melt analysis.

4. The ski edge profile of claim 2, wherein the alloying elements contain silicon as the main alloying element.

5. The ski edge profile of claim 2, wherein the alloying element is silicon in an amount of between approximately 0.3% and approximately 3.0%, based on the melt analysis.

6. The ski edge profile of claim 1, wherein it comprises a silicon-alloyed carbon steel.

7. The ski edge profile of claim 1, wherein it comprises a silicon-alloyed carbon steel containing approximately 0.5% to 0.8% of carbon and approximately 1.2% to approximately 2.3% of silicon.

8. The ski edge profile of claim 1, wherein it comprises a steel alloy whose thermal conductivity is reduced by additions of constituents which induce the formation of a solid solution.

9. The ski edge profile of claim 1, wherein it comprises a steel alloy with a thermal conductivity which is reduced by at least about a quarter, compared to conventional steel alloy.

10. The ski edge profile of claim 2, wherein the alloying elements which reduce the thermal conductivity form approximately 1.20–2.50%, based on the melt analysis.

11. The ski edge profile of claim 2, wherein the alloying element is silicon in an amount of between approximately 0.5% and approximately 2.5%, based on the melt analysis.

12. The ski edge profile of claim 3, wherein it comprises a silicon-alloyed carbon steel containing approximately 0.5% to 0.8% of carbon and approximately 1.2% to approximately 2.3% of silicon.

13. The ski edge profile of claim 2, wherein it comprises a steel alloy whose thermal conductivity is reduced by additions of constituents which induce the formation of a solid solution.

14. The ski edge profile of claim 1, wherein it comprises a steel alloy with a thermal conductivity which is reduced by about half, compared to hardenable C steels.

15. The ski edge profile of claim 1, wherein the thermal conductivity in the temperature range from −20 to +20° C. is less than approximately 30 W/mK.

16. A ski edge profile made from steel, comprising a steel alloy with a thermal conductivity in the temperature range from −20 to +20° C. is less than approximately 35 W/mK and has been reduced by at least one of nonmetallic, semimetallic, and metallic alloying elements, wherein the alloying elements which reduce the thermal conductivity form approximately 1.0% to 3.0%, based on the melt analysis.

17. The ski edge profile of claim 16, wherein silicon is the main alloying element.

18. A ski edge profile made from steel, comprising a steel alloy with a thermal conductivity less than approximately 35 W/mK in the temperature range from −20 to +20° C., wherein the steel is a silicon-alloyed carbon steel containing approximately 0.5% to 0.8% of carbon and approximately 1.2% to approximately 2.3% of silicon.

19. The ski edge profile of claim 18, wherein the thermal conductivity in the temperature range from −20 to +20° C. is less than approximately 30 W/mK.

* * * * *